United States Patent [19]

Fastje

[11] Patent Number: 5,038,527

[45] Date of Patent: Aug. 13, 1991

[54] SUCTION-HOOD FOR FACADE-CLEANING

[76] Inventor: Helmut Fastje, Kirchstrasse 26,, D-7303 Neuhasusen/Filder, Fed. Rep. of Germany

[21] Appl. No.: 427,335

[22] Filed: Oct. 27, 1989

[30] Foreign Application Priority Data

| | | | |
|---|---|---|---|
| Oct. 28, 1988 | [EP] | European Pat. Off. | 88117980 |
| May 11, 1989 | [DE] | Fed. Rep. of Germany | 8905874 |
| Aug. 19, 1989 | [EP] | European Pat. Off. | 89115350 |

[51] Int. Cl.[5] ..... B24C 9/00; B08B 5/02

[52] U.S. Cl. ..... 51/426; 51/429

[58] Field of Search ..... 51/410, 426, 436, 437, 51/429

[56] References Cited

U.S. PATENT DOCUMENTS

| | | | |
|---|---|---|---|
| 4,199,905 | 4/1980 | Neidigh et al. | 51/429 |
| 4,281,485 | 8/1981 | Chorila, III | 51/426 |
| 4,305,344 | 12/1981 | Bochett | 51/429 |
| 4,757,179 | 11/1988 | Lewis | 51/429 |
| 4,825,598 | 5/1989 | Schlich | 51/426 |

*Primary Examiner*—Frederick R. Schmidt
*Assistant Examiner*—Blynn Shideler
*Attorney, Agent, or Firm*—Shlesinger Arkwright & Garvey

[57] ABSTRACT

The invention concerns an evacuation hood which is part of facade-cleaning equipment with a sandblasting system used under the hood and of which the dust generation is limited to the dust-collection chamber bounded by the hood. For purposes of erection in the free areas of a scaffold, the hood comprises a peripheral wall 1 made of a flexible material; the hood's contour is determined by skeleton pipes 3, 5 inserted into pockets 4 at the hood corners and braced by tensioning means 12, 13 to the scaffold 14; a flexible curtain 6 acting as a seal and movable relative to the facade starts at the peripheral wall andis supported transversely to its direction of set-up by distributed spacers 3*a*, 5*a*, 8*a* and further can be set to be at varying distances to the facade.

22 Claims, 6 Drawing Sheets

SUCTION-HOOD FOR FACADE-CLEANING

Figure 2:
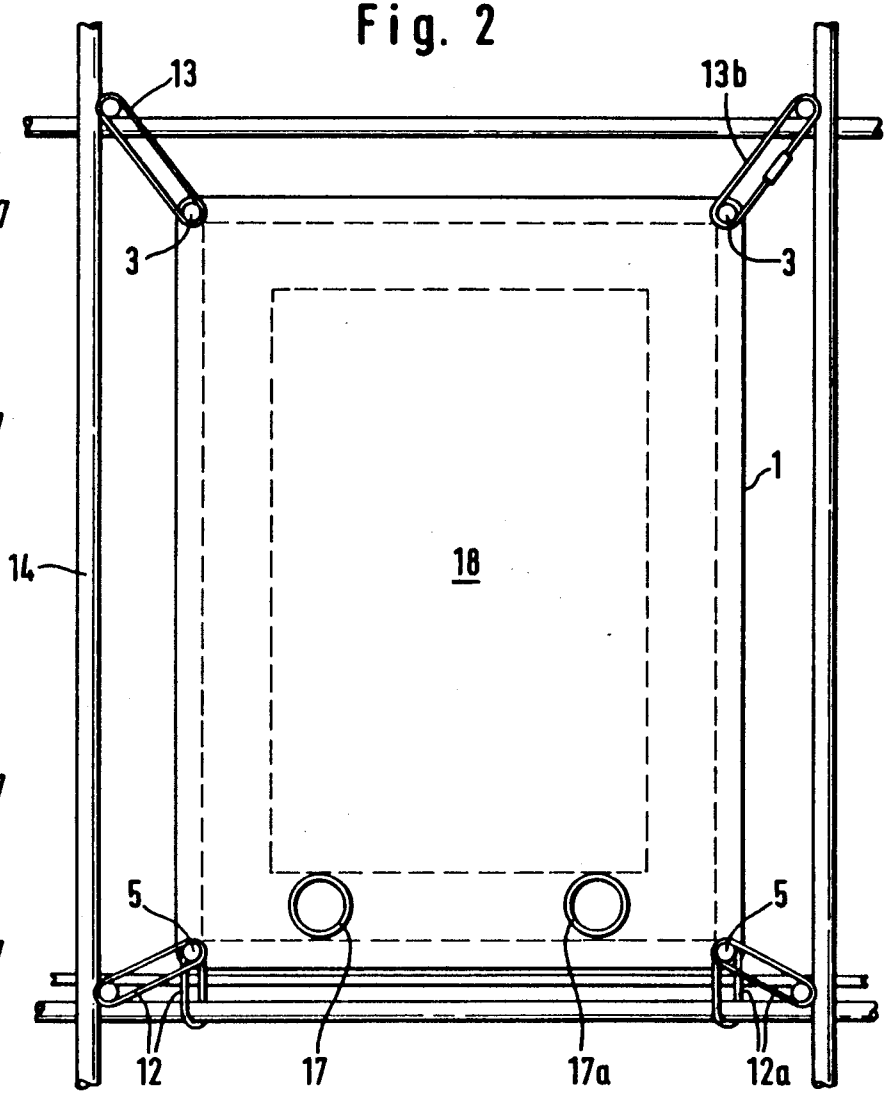

The invention concerns an evacuation-hood which is part of cleaning equipment for facades, reliefs and other stone surfaces, using compressed-air sand-blasting within, or below the hood comprising suction means mounted along its periphery issuing into the dust-collecting space it is bounding and onto sealing means applied to the surface being cleaned.

Operation of known cleaning equipment entails inadmissible ecological degradation because the surface dust and dirt layers abraded by the sandblast from the facade being cleaned form, in conjunction with the supplied compressed air, rapidly propagating clouds of dust.

In regard to the aforementioned, external propagation dust is eliminated by the evacuation hood enclosing the sandblast nozzle and by bounding, by means of a seal mounted along its periphery and resting against the surface being cleaned, a dirt-collection space, an external suction in the form of a partial-vacuum presence being provided in sealed manner along that periphery.

The object of the present invention is a further development of the evacuation hood in order to design more effectively the lateral sealing between the hood and the surface being cleaned by simple means, in that this seal shall hug more easily the varying contours of the surface being cleaned, i.e. so that it shall assure an effective seal relative to the outside of the surface being worked on by the sandblast. This problem is solved by the features of this invention.

A preferred embodiment of the invention provides a peripheral wall of a coated fabric or of a fiber-reinforced sheet which shall be set up in the free zones of a scaffold erected in front of a facade, its contour being determined by skeleton pipes inserted at the hood ends into fabric pockets and pointed perpendicularly at the facade, lower skeleton pipes being fixed to the scaffold and upper skeleton pipes being clamped so as to be free upward, with rods telescoping in the skeleton pipes whereby a fabric segment forming a flexible curtain covers the gaps between the fixed peripheral wall of the hood and the wall of the building.

The flexible, bellows-like segment of sheet or fabric may be tightly fastened to the end side of the hood by sewing, fusing, buttons or hook-and-loop fastener material and the like. A peripheral elevation of plastic foam may be provided at the end side of the flexible curtain telescoping by means of the rods in particular to seal the hood by applying it against the facade.

In another embodiment of the evacuation hood of the invention additional segments of sheets or fabrics are mounted to the collapsible flexible curtain along the four sides of the hood, and these segments can be unfolded downward, upward or laterally and be connected to the edge of the particular curtain segment by hook-and-loop fastener material or the like in order to achieve by such extension an overlap downward, upward or laterally of the facade at the gap to a neighboring hood.

In a variation of the above embodiment, the flexible curtain segments starting from the four sides of the hood each at the edge of the peripheral wall may be of a greater length than the hood side and be linkable to each other by means of buttons, zippers or hook-and-loop fastener material and the like and be independently folding in order to overlap in the flipped-open or unfolded state the facade in the gap between hoods mounted one above or one next to the other.

If the evacuation hood is used alone, that is without neighboring hoods, then the individual walls of the unfolding sheet or fabric segment may be connected by buttons or other means to each other in such a manner as to form an extensible continuation of the hood periphery, the individual curtain segments partly overlapping at the corners.

In order to stiffen the extensible flexible curtain, insertion pockets may be provided in the peripheral wall to selectively receive telescoping spacers tensioning the edge zone of the flexible curtain by means of buffers relative to the facade.

In a further significant feature of the invention, peripheral and in particular steel cables may be mounted, in particularly sewed into the front and rear edges of the peripheral wall of fabric or a sheet, these cables passing externally around the fabric pockets for the skeleton pipes to maintain the shape of the erected hood.

In order to effectively evacuate the cloud of dust restricted to the hood, a rear hood wall may be directly connected to the peripheral wall, said rear wall preferably comprising several passageways or hook-up stubs to suction lines connected to suction means. The design may be such that suction ducts extending along the rear wall around the hood periphery and stiffened by dimensionally stable inserts are provided which communicate with one or more suction ducts and comprise suction apertures pointing to the open hood side. In this case additional suction ducts or extension lines may be hooked up through which the suction can be become effective anywhere needed in the vicinity of the hood periphery.

In one variation the evacuation means is in the form of a suction line connected, in particular in detachable manner, through the hood rear wall and passing to the operational side, located inside along the edge of the flexible curtain pointing to the facade and comprising suction slots both lateral and pointing to the facade. Where called for, one or more segments of the suction line may be integrated into one or more hood walls or solidly assembled to them.

Another embodiment implements the sealing between the hood lateral walls and the facade in that at least the peripheral hood wall or substantial portions thereof are double-walled and inflatable. means being provided to rest the inflated hood, especially at the top and at the bottom sides, on the scaffold, to create thereby a sealing pressure to force the flexible curtain against the facade. In this embodiment the position of the sealing, flexible curtain can be pre-set by means of the telescoping spacers, whereby the desired clamping toward the facade is assured when inflating the hood or for instance the hood rear wall. The flexible curtain or the telescoping sheet or fabric segment itself may consist of an inflatable jacket of which the end side rests by a peripheral seal against the surface being cleaned.

In order that the operator of the sand-blast equipment have free access to a substantial work area or to adapt the evacuation hood to wider clear areas of the scaffold, another feature of the invention provides that the peripheral wall, the rear wall and the telescoping flexible curtain comprise a zone formed especially by transverse folding for the purpose of changing the hood length and/or the hood height and that the particular hood length or height be determined by the adjustability of the steel cables passing through pockets on both sides of the peripheral wall. Length-adjustable telescoping pipes may be inserted between the cables at the upper and lower sides of the peripheral wall. The folds of the stretchable zone may be guided in the longitudinal direction by attached lugs on the particular telescoping pipe.

Another basic solution of the invention for the above problem is an adaptable evacuation hood for sand blasting smaller areas and is characterized in that a central opening is present in an annular suction manifold-space to serve as the passageway for the sand blast nozzle, and in that starting from the manifold, a flexible curtain mounted outside to its periphery rests in the form of a seal against the facade and bounds a dust-collecting space hooked up to evacuation apertures, the flexible curtain resting on a series of individually longitudinally displaceable rods to which the curtain is connected by means of loops.

In a variation of the above-described evacuation hood, which illustratively is suitable for work on small-area stone reliefs, the perforated lower side of a suction manifold can be connected in the form of an operational aperture with lateral access to a cylindrical wall enclosing the dust collection chamber, this aperture being extended downward by a flexible curtain consisting of rods moving through guide pipes and displaceable parallel to the cylinder axis and further of a sheet illustratively held in displaceable manner by ring clips on the rods. Where called for, evacuation pipes may be provided from the suction manifold to the lower end of the cylindrical wall to apply vacuum as far as the lateral operational aperture.

In a further embodiment of the invention regarding a special application, in the event the hood assumes an angular shape at a building corner, two mutually orthogonal segments of the peripheral wall are connected by an oblique segment spanning the building corner and braced by spacers and skeleton pipes inserted into the pockets of the peripheral wall relative to the scaffold and the facade.

If a column must be cleaned, the evacuation hood may consist of a collapsible tarpaulin enclosing the column at a spacing by means of support rings held in straps, the tarpaulin being fixed to the upper end of the column. Depending on the height of the column, several support rings may be used which, for the sake of simple installation, are split and assemblable.

In another embodiment of the invention, which is applicable to all kinds of evacuation hoods, the telescoping segment acting as the peripheral seal consists of a series of single, laterally mutually inserting or overlapping shaped rods held displaceable in the longitudinal direction and prestressed in elastic manner toward the facade to be cleaned.

Further features and advantages of the evacuation hood of the invention are disclosed in the description below of illustrative embodiments shown in the drawings containing essential particulars of the invention. These features and moreover the claims whether considered singly or in arbitrary combination may form further embodiments of the invention.

All Figures are shown schematically.

Figure 1:
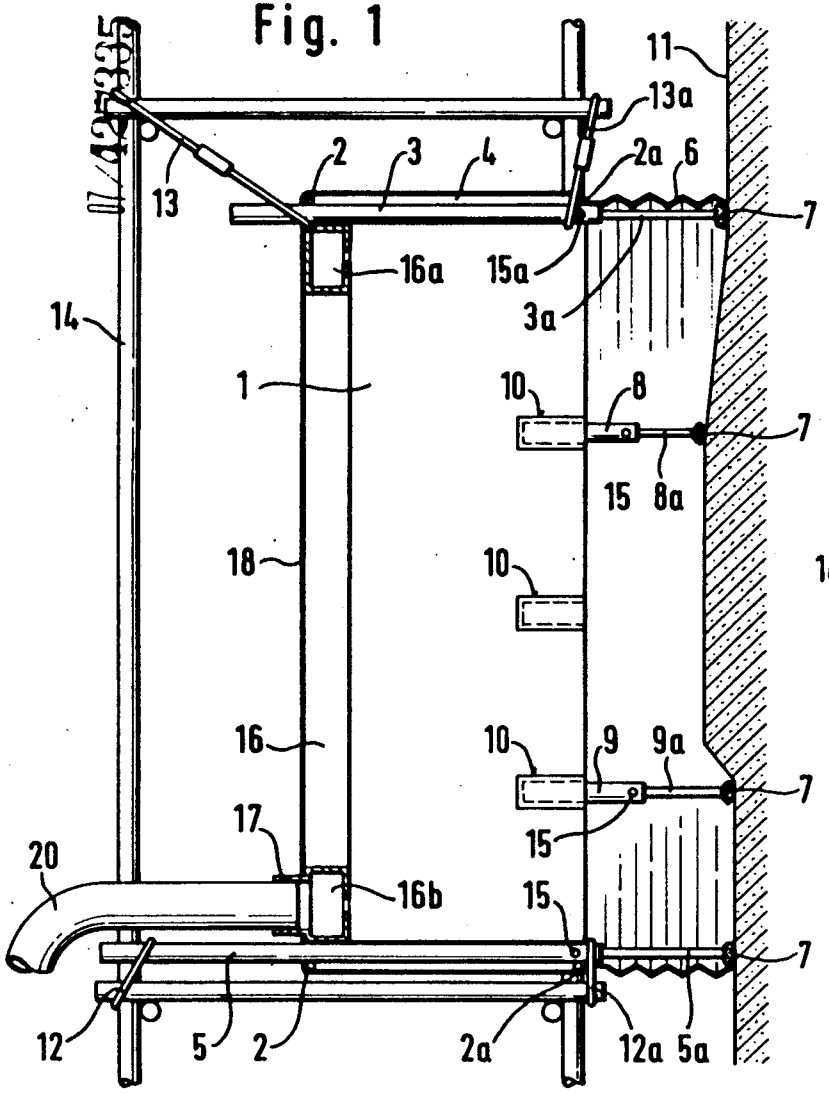
Figure 3:
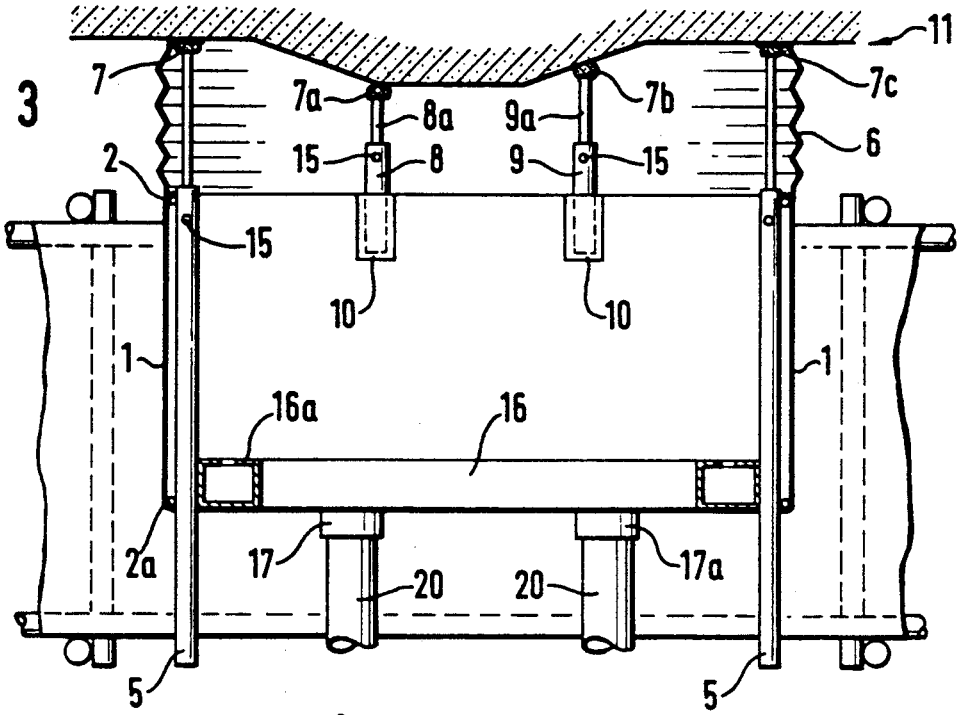
Figure 4:
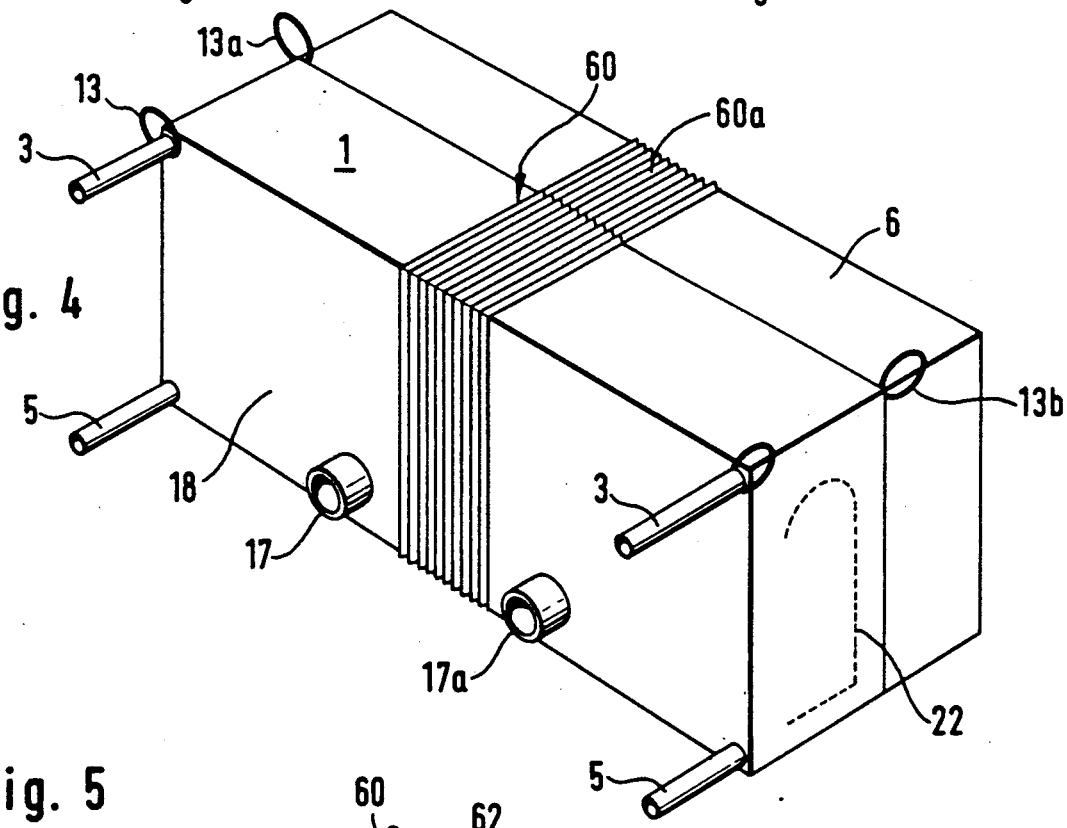
Figure 5:
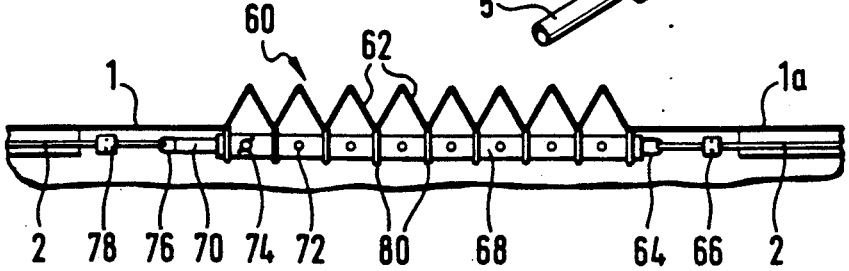
Figure 7:
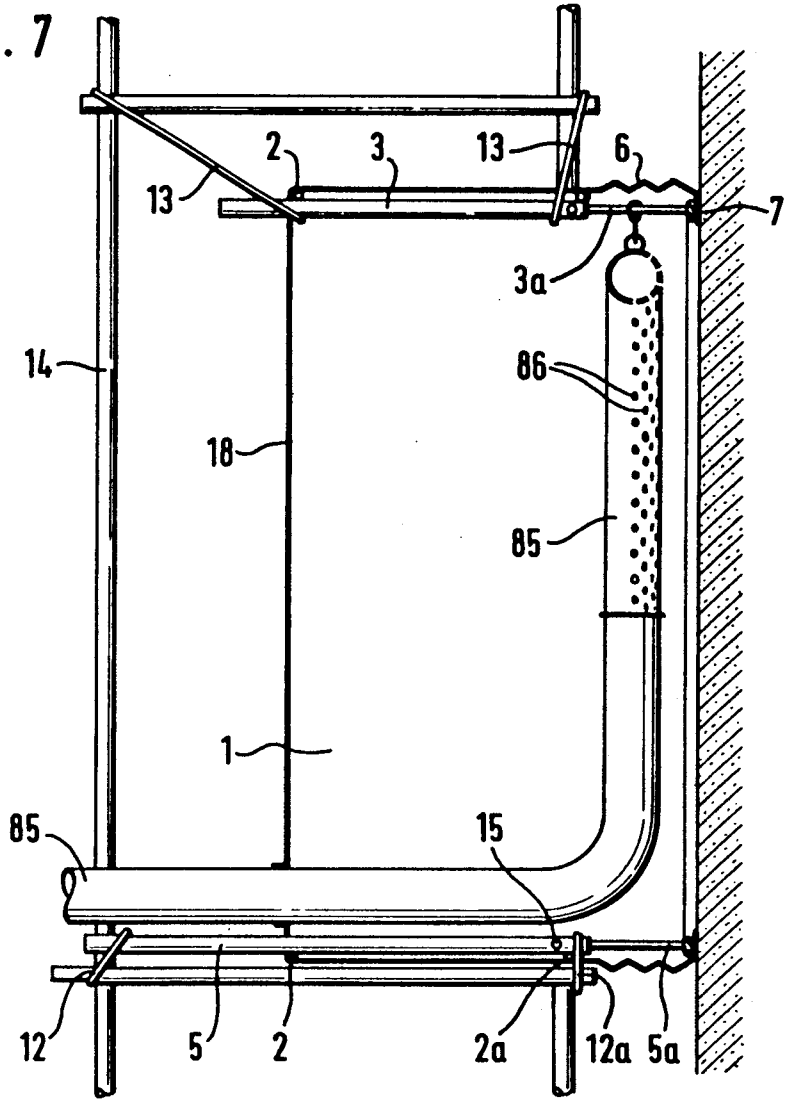
Figure 6:
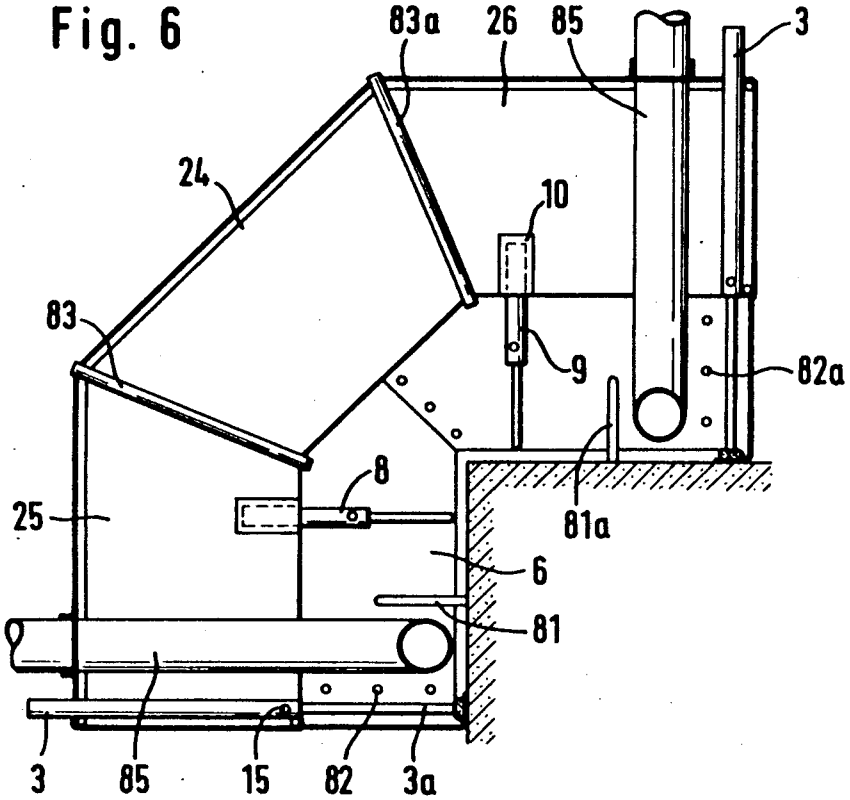
Figure 8:
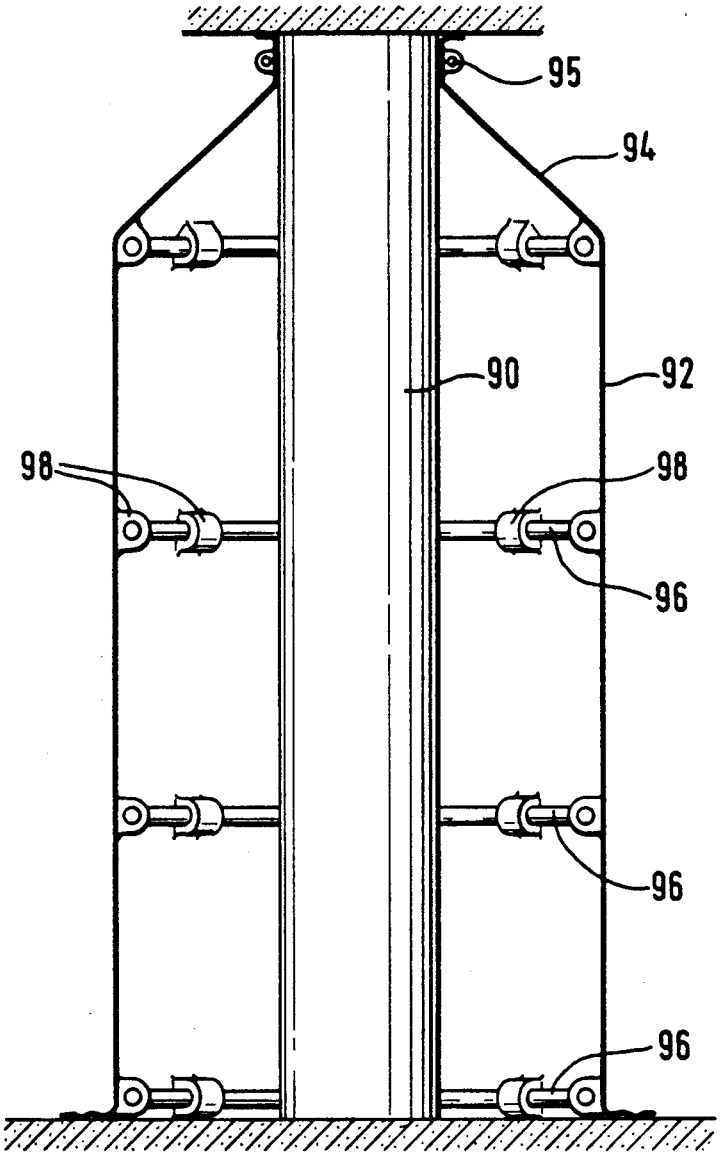
Figure 9:
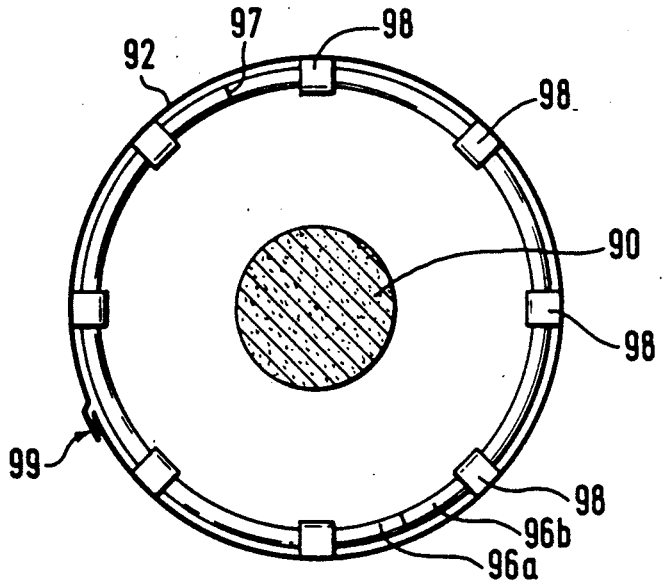
Figure 10:
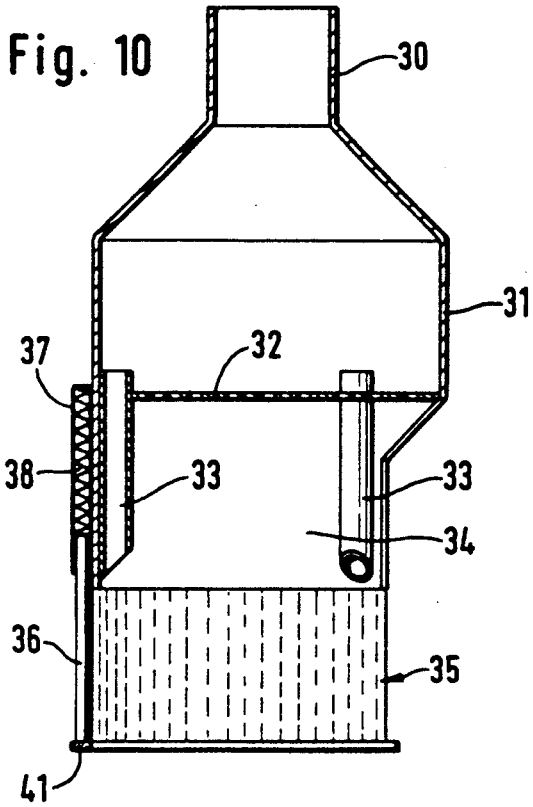
Figure 11:
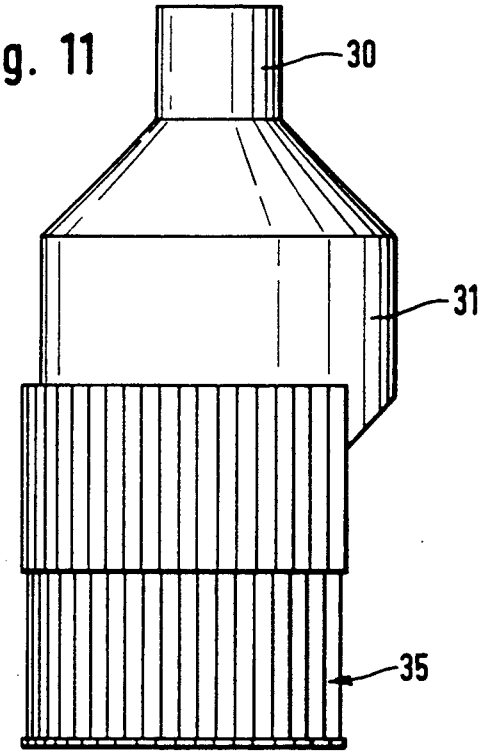
Figure 12:
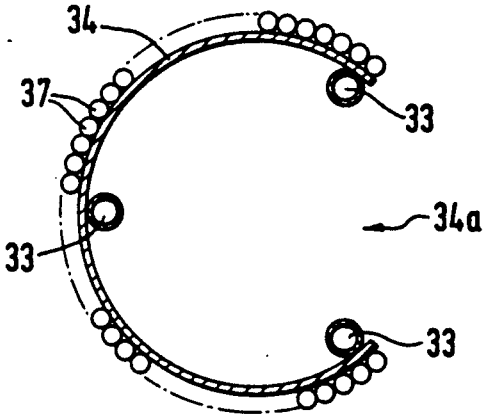
Figure 13:
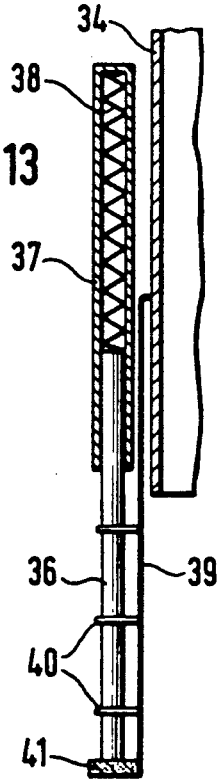
Figure 14:
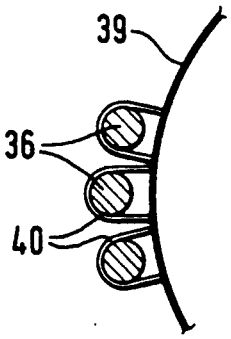
Figure 15:
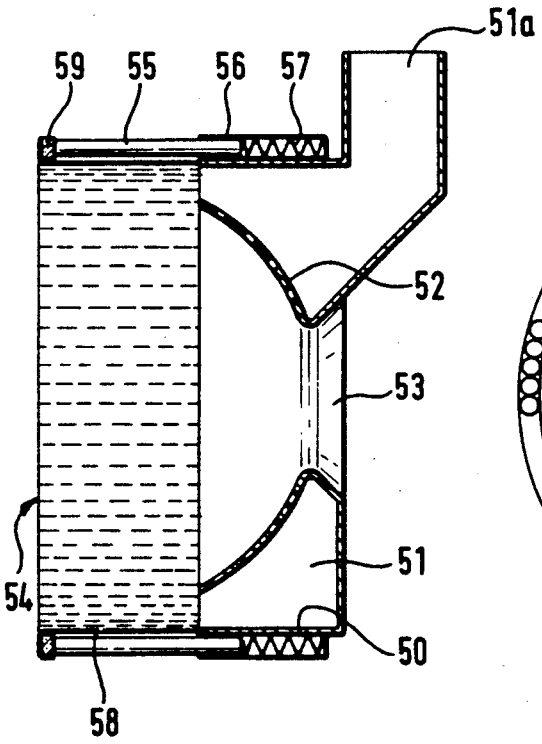
Figure 16:
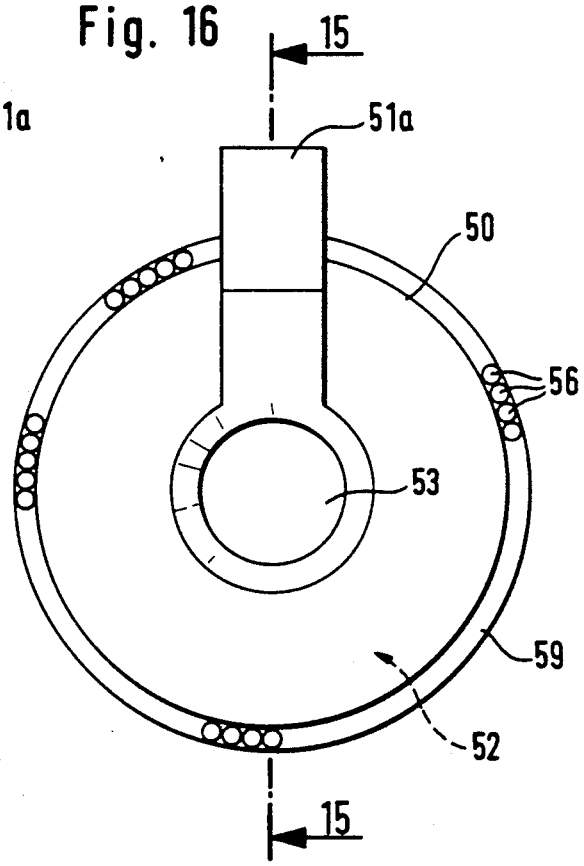

FIG. 1 is a partial sectional side view of an evacuation hood of the invention set up on a scaffold, FIG. 2 is a view of the back side of the set-up evacuation hood of FIG. 1, FIG. 3 is a partial top view of the evacuation hood of FIGS. 1 and 2, FIG. 4 is a perspective of a set-up evacuation hood of adjustable length, FIG. 5 is a partial section of a stretchable wall of the evacuation hood of FIG. 4, FIG. 6 is a partial top view of an angular evacuation hood which is a variation of that of FIG. 3, FIG. 7 is a partial sectional side view of a set-up evacuation hood which is a variation of that of FIG. 1, FIG. 8 is a vertical section of an evacuation hood to treat a column, FIG. 9 is a horizontal section of the evacuation hood of FIG. 8, FIG. 10 is a partial sectional side view of an evacuation hood for manual sand blasting, FIG. 11 is a side view of the evacuation hood of FIG. 10, FIG. 12 is a horizontal section of the evacuation hood of FIG. 10 at the height of the cylindrical wall, FIG. 13 is an enlarged partial sectional view of longitudinally guided rods forming a curtain, of FIG. 10, FIG. 14 is a horizontal section of the system of FIG. 13, FIG. 15 is a variation of the evacuation hood for sand blasting small, vertical areas, and FIG. 16 is a top view of the evacuation hood of FIG. 15.

FIGS. 1 through 3 show an evacuation hood which can be fitted to the free areas of a scaffold erected in front of a building facade and which can be moved from a collapsed transport-state into its unfolded form and be set up at any suitable scaffold position. One feature of this evacuation hood is that a plastic tarpaulin reinforced with resistant fibers or a fabric coated with plastic or an elastomer forms a peripheral wall 1 closing on itself. The evacuation hood is the size of a work-cabin and is sealed by a back wall 18 sealed, bonded or sewed to the peripheral wall 1. Continuous and preferably steel cables 2, 2*a* are sewn-in at the front and rear end sides of the peripheral wall 1 and maintain the cabin-shape of the evacuation hood in the set-up condition. It is clear from FIGS. 1 and 2 that the contour of the set-up evacuation hood is determined by four skeleton pipes 3, 5 perpendicular to the facade 11 and inserted into pockets 4 of the peripheral walls at the edges of the hood.

When erecting the evacuation hood, first the two lower skeleton pipes 5 are affixed laterally and at the bottom to the scaffold 14. The components indicated in FIGS. 1 and 2 are used for that purpose, preferably the node points between the horizontal and vertical bars of the scaffold 14 to which the skeleton pipes 5 are connected by means of connectors 12, 12*a* that may be clamping or adjustable belts, shackles, bails or lugs. In this example the upper skeleton pipes 3 do not physically touch the scaffold, instead, as shown in FIGS. 1 and 2, they are freely braced upward and to the side by tensioning means 13, 13*a*, 13*b* in the form of turnbuckles, clamps and shackles.

As shown by FIGS. 1 and 3, the evacuation hood continues at the edge of the peripheral wall 1 facing the facade 11 by a flexible curtain 6 consisting of a segment of sheet or fabric of the same material as the back and the peripheral walls and which may be designed like an accordion or bellows to overlap and seal the different gaps between the end edge of the peripheral wall 1 and the facade 11 of FIGS. 1 and 3.

The flexible curtain may be connected in integral manner or by sewing, fusing, by buttons or by a velcro connector or the like. A peripheral foam belt may be mounted at the free edge near the facade to seal same. The flexible curtain 6 rests on rods 3*a*, 5*a* telescoping in the skeleton pipes 3, 5, and these rods may extend through inside shackles of the curtain.

The lateral, upper and lower areas of the peripheral wall 1 are fitted with insertion-pockets 10, 10*a* which, where called for, shall receive telescoping spacers 8, 9 and serve to additionally support the flexible curtain 6.

The spacers 8, 9 each consist of a basic case inside which a telescoping rod 8*a* and 9*a* resp. can be displaced and be fixed in place by a screw 15. The telescoping rods 3*a*, 5*a*, 8*a* and 9*a* are provided at their front ends with foam-shapes 7 which come to rest against the inwardly folded curtain edge of the facade 11 as shown in FIGS. 1 and 3.

The rear wall 18 connected to the peripheral wall comprises several passageways 17 serving as hook-up means for external suction lines 20. These hook-up means issue within the evacuation hood and as shown in FIG. 2 into evacuation ducts passing along the hood periphery and stiffened by dimensionally stable insets, these ducts communicating with one another and comprising slots or apertures pointing toward the open side of the hood. As shown by FIG. 1, upper and lower, horizontal, dimesionally-stable ducts 16*a*, 16*b* are mounted on or near the back wall 18 to evacuate the dust, said ducts being fastened to the back wall 18 and being provided with suction slots pointing toward the open hood-side. The upper horizontal duct may connected by means of vertical and reinforced hoses with the lower duct 16*b* and jointly with same to the passageways 17.

In an omitted embodiment mode, the flexible curtain 6 widening the flexible curtain 6 broadening the peripheral wall 1 will not extend continuously over the hood periphery but instead it is a single segment connected only to one peripheral edge of the work cabin and as a single segment it may be separated from the other, neighboring segments of the curtain. Detachable connection means such as buttons, hook-and-loop fastener material or the like, or zippers are used for that purpose. Illustratively considering these single curtain segments in relation to FIG. 1 and the horizontal position shown therein of the lower and upper walls, said segments may there be resp. unfolded down or up so as to be connected with a curtain edge which otherwise would be made to rest against the facade 11 of a comparable evacuation hood present above or below, and again buttons and buttonholes, zippers or hook-and-loop fastener material and the like are used to make this connection. However a connection also may be made to the edge of a peripheral wall 1 of the neighboring evacuation hood lacking a flexible curtain 6, whereby in every case a facade area between the two hoods shall be substantially covered a distance from the facade and can be worked on at once.

In a variation of the embodiment, the individualizable segments of the flexible curtain 6 are longer than the wall side of the evacuation hood from which they start. The length projecting on both sides may correspond at least to the depth by which the flexible curtain is stretched to a maximum by means of the telescoping rods 3*a*, 5*a*, 8*a*, 9*a*. Accordingly, and as regards FIG. 2, if using the wall segment unfolded from the top side of the hood, the distance is overlapped as far as to an evacuation hood mounted above on the scaffold, then the projecting lengths of lateral curtain segments that remain folded shall be capable of tightly sealing the said space up the evacuation hood mounted above also on both sides. Corresponding steps are feasible to overlap and seal a gap between two laterally mounted evacuation hoods or as regards a set of three or four juxtaposed and superposed evacuation hoods.

In an additional but omitted variation, the same individualizable above described curtain segments may be mounted along the four sides of the flexible curtain 6 shown in FIG. 1 whereby these individualizable curtain segments can be used and unfolded as needed, not from the peripheral wall 1 but from the outer edge of the shown flexible curtain 6, namely downward, upward or to the side. In this manner the hood can be extended upward, downward or to the side to a recessed facade zone, or overlap of the variable gap to a neighboring hood may be achieved while simultaneously obtaining also a variable spacing between the hood part fixed to the scaffold and the larger-scale facade.

FIGS. 4 and 5 show a further embodiment of the evacuation hood, with omission of the scaffold. As previously, the evacuation hood is erected in the free spaces of the scaffold includes a fiber-reinforced plastic tarpaulin or a coated fabric forming the closed peripheral wall 1 with the adjoining back wall 18. To better match free scaffold spaces of different widths, a folding zone 60 is provided in the peripheral wall 1 to vary the hood length. The accordion-type zone 60 continues beyond the back wall 18 and the bottom of the peripheral wall 1 as far as the flexible curtain 6 which in turn is provided in accordion-manner with omitted longitudinal folds, or which may be merely pushed together like a flexible tarpaulin in order to match variable distances to the facade. The flexible curtain 6 may be provided in the folding region 60 with bonded or sewed rubber bands keeping it drawn together to a minimum length. On the other hand the rubber bands also may be mounted transversely in order to keep the flexible curtain drawn together in the normal position until it shall be stretched by means of the insertable telescoping spacers 8, 9.

FIG. 4 shows the upper and lower skeleton pipes 3 and 5 resp. held at the corners of the hood and forming the anchor points when erecting, which are joined at the lower ends to the scaffold, the upper skeleton pipes 3 being tightened laterally and upward by means of the loops or buckles 13*a*, 13*b* and additional tightening means.

A hood entrance 22 sealable by a zipper is present at one side of the peripheral wall 1. In the same manner as for the embodiment mode of FIGS. 1 through 3, pipe stubs 17 are provided as passageways for suction lines in the back wall 18 and are connected inside the hood to a manifold. This manifold can issue into upper and lower horizontal; ducts containing suction slots pointing at the facade and moreover being provided with an elastic zone capable of following the just-set elongation or contraction of the matchable evacuation hood.

An embodiment mode of the collapsible zone 60 is schematically shown as a vertical section in FIG. 5. On one hand FIG. 5 shows one of the steel cables 2 passing below the top side of the peripheral wall 1 through pockets sewed into it and being returned as shown in FIG. 5 by one end through a connection lug 64 and affixed to a cable clamp 66. The connection lug 64 starts at the end of a pipe 68 inside of which an inner pipe 70 can be displaced. Both pipes contain a series of equispaced apertures 72.

When the apertures 72 of the telescoping pipes 68, 70 are aligned, these pipes will be locked in their particular relative positions by a cotter pin or the like or a screw 74. The inner pipe 70 bears a connection lug 76 through which passes the other end of the steel cable 2 being fixed in place by a cable clamp 78. The fabric of the peripheral wall 1 is present in the area 60 in the form of folds 62 guided by means of hooks 80 slipped on the pair of telescoping pipes 68, 70.

In such a simple embodiment, the tensioning cables 2 passing through pockets at the front and rear edges of the peripheral wall are interrupted at the top and bottom each time by a telescoping pipe system 68, 70 as shown in FIG. 5 and thereby, including the folding area 60, are equally adjustable in length. Appropriately the hooks 80 starting from the folds are located at the four corners of the folding area 60. The folding zones 60*a* belonging to the flexible curtain 6 at the top and the bottom sides of the evacuation hood are kept stretched or elongated in the longitudinal direction at the transition to the peripheral wall 1 by means of the adjustable telescoping pipes 68, 70, intrinsic compensation taking place at the edge of the curtain 6 resting against the facade. At this end side the curtain may be provided in order to achieve a sealing rest against the facade with a foam-rubber seal. As described in relation to the first embodiment, the four segments of the flexible curtain 6 may be individually separate from the other segments. This applies foremost to the horizontal segments which are unfolded up or down and are connected with a corresponding horizontal wall or a lateral segment of the neighboring hood above or below on the scaffold.

FIG. 6 shows a variation of the invention in the form of an evacuation hood mounted around a facade corner and connected to the corner posts of the (omitted) scaffold, whereby the oblique hood segment 24 is tensioned and its location is determined by the skeleton pipes 83, 83*a*. The flexible curtain 6 matching the facade and adjoining the segments 25 and 26 of the peripheral wall 1 is equipped in the corner and boundary zones with buttons or similar connectors. Folds of curtain stressed by the telescoping pipes in the direction of the facade 11 are denoted at sites 81 and 81*a*. The connecting means 82 and 82*a* for the curtains of neighboring hoods include snap-fasteners, hook-and-loop fastener material or the like, the ends of the curtains 6 of neighboring hoods being mutually overlapping.

By means of a vertical section through an evacuation hood in the manner of the first embodiment, FIG. 7 shows that dust-removal can be carried out using one or more passageways 17 of flexible suction conduits 85 laid at the back wall and passing at the open end side of the hood in the facade region. The pipe 85 comprises perforations 86 and may be suspended from the tensioning rods 3*a*, whereby it is being made to pass at a tight spacing from the facade along the inside of the evacuation hood or its flexible curtain 6. Thereby effective sealing and evacuation of the dust in the immediate vicinity of its generation is assured.

FIGS. 8 and 9 show an evacuation hood for surface-working a column 90. The hood consists of a collapsible tarpaulin 92, a cable passing through lugs 95 in the upper, tapering segment 94 where it can be tightened. The tarpaulin 92 is kept erected in height by means of support rings 96 consisting of two tubular segments 96*a*, 96*b* which when erecting the hood plug into each other. Appropriately runners 98 holding the support rings 96 are mounted at the inside periphery of the tarpaulin. Hook-up of the ring segments are shown at site 97. At the site 99, the tarpaulin overlaps and is kept together by snap fasteners or hook-and-loop fastener material connections.

Whereas the evacuation hoods described in relation to FIGS. 1 through 9 describe the working space for the facade-cleaner, smaller evacuation hoods are provided for sandblasting for instance reliefs or restricted areas. Such an evacuation hood may be supported on and guided by an omitted operational arm of a boom or manipulator while the operator stays on a scaffold or neighboring platform from where he guides the sandblasting nozzle into or underneath the hood.

The evacuation hood of FIGS. 10 and 11 comprises a drum-like housing 31 with a hook-up stub 30 for a hose leading to a suction and filtering unit. Inside the housing 31, a perforated horizontal plate partitions an upper suction manifold chamber from a dust collecting chamber below. Latter is formed by a cylindrical wall 34 which, as shown by FIG. 12, comprises a lateral operational opening 34*a* through which the sandblasting nozzle is pointed at the surface being treated.

Movable rods 36 are mounted on the external circumference of the cylindrical wall 34 parallel to the axis of the cylinder and displaceable within guiding pipes 37; these rods are adjustable individually and on account of touching mutually by their sides act as seals and are pressed by a prestressing spring 38 against the surface being treated. The guide pipes 37 are shown only in part at the circumference of the wall 34 of FIG. 12, even though they may cover all the circumference. The rods 36 projecting form the guide pipes 37 are provided at their lower ends with pads or a sealing strip 41 which may extend over the entire circumference of the sealing support.

As shown by FIGS. 13 and 14, the rods 36 are enclosed by loops 40 mounted to a flexible curtain 39. If a curtain 39 assuming sealing is present and moves up and down together with the rods 36, the rods 36 and the guide pipes may be spread at substantial spacings across the wall 34. The curtain 39 consists of a coated fabric or of a fiber-reinforced plastic tarpaulin. The suction pipes 33 starting as shown in FIGS. 10 and 12 at the suction manifold above the perforated wall extend as far as the lower end of the cylindrical wall 34 in order to spread the suction in the lower region of the flexible curtain and thereby to prevent as much as possible dust propagation to the outside at the level of the operational opening 34*a*.

An evacuation hood that can be fitted to non-planar surfaces and similar to the embodiments of FIGS. 10 through 14 is shown by FIGS. 15 and 16. This evacuation hood consists of a drum-like housing 50 with an annular suction manifold 51 comprising a central intake opening 53 for the sandblasting nozzle and an upper suction-duct sealing stub 51*a*. The manifold space is separated by a perforated, bell-shaped inner wall 52 from the dust-collection space inside the hood. A flexible curtain made of fabric or of a reinforced sheet is present over the external circumference of the drum-shaped housing 50 and rests by its seal 59 against the surface being cleaned, bounding the duct-collection space relative to the outside. The flexible curtain 54 is supported and formed in part by a series of rods 55 which are individually displaceable longitudinally and to which the fabric 58 of the flexible curtain is affixed by loops in the manner already discussed in relation to the embodiment of FIGS. 4 through 8. A circumferential seal 59, illustratively a strip of foam rubber, is present at the lower end of rods 55 passing through the guiding pipes 56 and is prestressed by the spring 57. The evacuation hoods of FIGS. 10 through 16 may be guided automatically or by remote control along the surface being cleaned, in which case the sandblasting nozzle shall be hooked-up to the housing 50 or guided parallel to it.

I claim:

1. A hood for use with cleaning equipment using compressed-air sandblasting for cleaning facades, reliefs and other stone surfaces, comprising:

(a) an enclosure means including at least one wall forming a dust-collection chamber;

(b) said chamber including a peripheral rim;

(c) said peripheral rim including sealing means for preventing the escape of dust from said enclosure means at said peripheral rim;

(d) said sealing means is formed of a flexible curtain connected to said peripheral rim and is extensible outwardly therefrom; and, (e) adjustable spacing means connected to said peripheral rim and extending perpendicularly to said peripheral rim for supporting said sealing means extendibly from said peripheral rim; and, (f) said at least one wall is connectable to a scaffold;

(g) said at least one wall having a contour formed by skeleton pipes extending substantially perpendicularly to said peripheral rim;

(h) said at least one wall having corners;

(i) said corners including pockets formed therein;

(j) said skeleton pipes being insertable into said pockets;

(k) said skeleton pipes including upper skeleton pipes and lower skeleton pipes wherein said lower skeleton pipes are connectable to said scaffold to form anchor points and said upper skeleton pipes being connected to spatially acting tensioning means; and, (l) said skeleton pipes including rods telescopingly guided within said skeleton pipes for allowing said sealing means to conform to the surface.

2. The hood as defined in claim 1, wherein:

(a) said sealing means is collapsible and is fixedly connected to said peripheral rim.

3. The hood as defined in claim 1, wherein:

(a) said sealing means is collapsible and is releasably connected to said peripheral rim.

4. The hood as defined in claim 1, wherein:

(a) said sealing means is extensible together with said telescoping rods; and, (b) said sealing means includes an edge having a peripheral strip of foam material thereon.

5. The hood as defined in claim 4, wherein:

(a) said enclosure means includes at least one additional chamber formed adjacent said first chamber and said sealing means includes flexible segments mounted thereto and being connectable to said additional chamber to form a continuous seal between said chambers.

6. The hood as defined in claim 5, wherein:

(a) said flexible segments are removably attachable to said peripheral rim of each of said chambers.

7. The hood as defined in claim 1, wherein:

(a) said sealing means and said peripheral rim each include complementary insertion pockets for selectively receiving said adjustable spacing means.

8. The hood as defined in claim 1, wherein:

(a) said at least one wall includes peripheral cables mounted thereon to stabilize said at least one wall forming a dust collection chamber.

9. The hood as defined in claim 1, wherein:

(a) said skeleton pipes and said at least one wall is provided with connection means for joining said enclosure means to a scaffold.

10. The hood as defined in claim 1, wherein:

(a) said enclosure means includes two mutually orthogonal segments joined by an oblique segment which are braced relative to said scaffold by said skeleton pipes.

11. The hood as defined in claim 1, wherein:

(a) said at least one wall and said second wall are formed of fiber-reinforced sheet material; and, (b) said pockets for receiving said pipes are bonded to said at least one wall and said second wall.

12. The hood as defined in claim 1, wherein:

(a) said at least one wall includes an opening formed therein for receiving a sandblasting nozzle.

13. A hood for use with cleaning equipment using compressed-air sandblasting for cleaning facades, reliefs and other stone surfaces, comprising:

(a) an enclosure means including at least one wall forming a dust-collection chamber;

(b) said chamber including a peripheral rim;

(c) said peripheral rim including sealing means for preventing the escape of dust from said enclosure means at said peripheral rim;

(d) said sealing means is formed of a flexible curtain connected to said peripheral rim and is extensible outwardly therefrom;

(e) adjustable spacing means connected to said peripheral rim and extending perpendicularly to said peripheral rim for supporting said sealing means extendibly from said peripheral rim;

(f) said enclosure means includes a second wall forming a back wall of said dust collection chamber;

(g) said back wall includes passageways formed therein including hook-up stubs for connection to suction lines connected to a suction means for withdrawing dust from said dust-collection chamber;

(h) said enclosure means includes suction ducts formed along said back wall;

(i) said suction ducts include inserts for providing dimensional stabilization; and, (j) said suction ducts include openings for allowing passage of dust from said chamber into said ducts and means for communicating with said suction lines to remove said dust from said dust-collection chamber.

14. A hood for use with cleaning equipment using compressed-air sandblasting for cleaning facades, reliefs and other stone surfaces, comprising:

(a) an enclosure means including at least one wall forming a dust-collection chamber;

(b) said chamber including a peripheral rim;

(c) said peripheral rim including sealing means for preventing the escape of dust from said enclosure means at said peripheral rim;

(d) said sealing means is formed of a flexible curtain connected to said peripheral rim and is extensible outwardly therefrom;

(e) adjustable spacing means connected to said peripheral rim and extending perpendicularly to said peripheral rim for supporting said sealing means extendibly from said peripheral rim;

(f) said enclosure means includes a second wall forming a back wall of said dust collection chamber;

(g) said back wall includes passageways formed therein including hook-up stubs for connection to suction lines connected to a suction means for withdrawing dust from said dust-collection chamber;

(h) each of said suction lines is detachably connected to said back wall; and, (i) each of said suction lines includes a slotted portion extending into said dust-collection chamber.

15. The hood as defined in claim 14, wherein:

(a) each of said suction lines is integrated into at least one of said walls of said enclosure means.

16. A hood for use with cleaning equipment using compressed-air sandblasting for cleaning facades, reliefs and other stone surfaces, comprising:

(a) an enclosure means including at least one wall forming a dust-collection chamber;

(b) said chamber including a peripheral rim;

(c) said peripheral rim including sealing means for preventing the escape of dust from said enclosure means at said peripheral rim;

(d) said sealing means is formed of a flexible curtain connected to said peripheral rim and is extensible outwardly therefrom;

(e) adjustable spacing means connected to said peripheral rim and extending perpendicularly to said peripheral rim for supporting said sealing means extendibly from said peripheral rim;

(f) said at least one wall forming a dust-collection chamber is formed of a double-layer construction whereby said at least one wall is inflatable; and, (g) means for maintaining said enclosure means in a fixed position relative to a scaffold.

17. The hood as defined in claim 16, wherein:

(a) said sealing means includes an inflatable jacket.

18. A hood for use with cleaning equipment using compressed-air sandblasting for cleaning facades, reliefs and other stone surfaces, comprising:

(a) an enclosure means including at least one wall forming a dust-collection chamber;

(b) said chamber including a peripheral rim;

(c) said peripheral rim including sealing means for preventing the escape of dust from said enclosure means at said peripheral rim;

(d) said sealing means is formed of a flexible curtain connected to said peripheral rim and is extensible outwardly therefrom;

(e) adjustable spacing means connected to said peripheral rim and extending perpendicularly to said peripheral rim for supporting said sealing means extendibly from said peripheral rim;

(f) said enclosure means includes an extensible region formed of folded wall-forming material which allows said enclosure means to be selectively enlarged;

(g) said at least one wall includes telescoping pipes extending through said extensible region; and, (h) said telescoping pipes include cables attached thereto for adjustably enlarging said enclosure means.

19. The hood as defined in claim 18, wherein:

(a) said telescoping pipes are connected to said at least one wall and provide dimensional stability to said at least one wall.

20. A hood for use with cleaning equipment using compressed-air sandblasting for cleaning facades, reliefs and other stone surfaces, comprising:

(a) an enclosure means including at least one wall forming a dust-collection chamber;

(b) said chamber including a peripheral rim;

(c) said peripheral rim including sealing means for preventing the escape of dust from said enclosure means at said peripheral rim;

(d) said sealing means is formed of a flexible curtain connected to said peripheral rim and is extensible outwardly therefrom;

(e) adjustable spacing means connected to said peripheral rim and extending perpendicularly to said peripheral rim for supporting said sealing means extendibly from said peripheral rim;

(f) said at least one wall is cylindrically shaped about a central axis and includes a lateral operational opening therein;

(g) said adjustable spacing means includes a plurality of rods movable parallel to the central axis of said cylindrical chamber and said rods are guided in guide pipes; and, (h) said sealing means includes loops formed thereon for encircling each of said rods.

21. The hood as defined in claim 20, wherein:

(a) said enclosure means includes suction pipes located within said chamber for providing suction at said peripheral rim and near said lateral operational opening.

22. The hood as defined in claim 21, wherein:

(a) said rods are elastically held in position to extend longitudinally outwardly from said peripheral rim.

* * * * *

UNITED STATES PATENT AND TRADEMARK OFFICE

CERTIFICATE OF CORRECTION

PATENT NO. : 5,038,527

DATED : August 13, 1991

INVENTOR(S) : Helmut Fastje

It is certified that error appears in the above-identified patent and that said Letters Patent is hereby corrected as shown below:

On the title page, Item

In Section [76] on the front page of the patent, the portion of the address reading "Neuhasusen/Filder" should read --Neuhausen/Filder--.

Signed and Sealed this

Ninth Day of March, 1993

*Attest:*

STEPHEN G. KUNIN

*Attesting Officer*

*Acting Commissioner of Patents and Trademarks*